US008100700B2

(12) United States Patent
Chen et al.

(10) Patent No.: US 8,100,700 B2
(45) Date of Patent: Jan. 24, 2012

(54) LOW PROFILE ELECTRICAL CONNECTOR TERMINAL AND METHOD OF MOUNTING TERMINAL ON PRINTED CIRCUIT BOARD

(75) Inventors: Ming-Yue Chen, New Taipei (TW); Chun-Hung Liu, New Taipei (TW)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 13/118,587

(22) Filed: May 31, 2011

(65) Prior Publication Data

US 2011/0294316 A1 Dec. 1, 2011

(30) Foreign Application Priority Data

May 31, 2010 (CN) ..... 099210242

(51) Int. Cl.
*H01R 12/00* (2006.01)

(52) U.S. Cl. ..... 439/66; 439/83

(58) Field of Classification Search ..... 439/66, 439/83

See application file for complete search history.

(56) References Cited

U.S. PATENT DOCUMENTS

| | | | | |
|---|---|---|---|---|
| 6,024,585 | A * | 2/2000 | Mickievicz et al. | 439/83 |
| 6,312,265 | B1 * | 11/2001 | Mohtar et al. | 439/79 |
| 6,497,581 | B2 * | 12/2002 | Slocum et al. | 439/66 |
| 6,554,634 | B1 | 4/2003 | Lin et al. | |
| 6,926,563 | B2 | 8/2005 | Morana et al. | |
| 2002/0019152 | A1 * | 2/2002 | Eldridge et al. | 439/66 |
| 2005/0227508 | A1 * | 10/2005 | Syms | 439/66 |

* cited by examiner

*Primary Examiner* — Tho D Ta

(74) *Attorney, Agent, or Firm* — Andrew C. Cheng; Wei Te Chung; Ming Chieh Chang

(57) ABSTRACT

An electrical connector assembly comprises a printed circuit board (PCB) having opposite upper and lower surfaces, an insulating housing having opposite top and bottom surfaces and a plurality of terminals disposed on a bottom surface thereof. Each terminal defines a fusible member disposed thereon. The insulating housing can place the terminal on the upper surface of the PCB and is removed from the terminals after the terminals are soldered on the PCB through the fusible members.

11 Claims, 9 Drawing Sheets

LOW PROFILE ELECTRICAL CONNECTOR TERMINAL AND METHOD OF MOUNTING TERMINAL ON PRINTED CIRCUIT BOARD

BACKGROUND OF THE INVENTION

1. Field of the Invention

The present invention relates to an electrical connector terminal, and more particularly relative to an electrical connector terminal having a structure for interconnecting two electronic systems, such as a CPU chip and a printed circuit board. The present invention also relates to a method of implanting the electrical connector terminal on a printed circuit board (PCB).

2. Description of Related Art

An electrical connector for electrically connecting a CPU (central processing unit) to a PCB (printed circuit board), disclosed in U.S. Pat. No. 6,554,634 which is issued to Liao on Apr. 29, 2003 comprises an insulating housing having a plurality of terminals received therein and a plurality of fusible members soldered on the terminals. Each terminal comprises a base portion extending in a vertical direction, an engaging portion extending from a top end of the base portion and a soldering portion extending from a bottom end of the base portion. The electrical connector establishes electrical connection between the CPU and the PCB through the engaging portion contacting with a corresponding pin of the CPU and the soldering portion soldered to the PCB through fusible members.

However, a warping deformation of the insulating housing of such electrical connector assembly is occurred when the terminals are soldered to the PCB through the fusible member, thus, electrical connection between the CPU and the PCB will be affected. In addition, the base portion, the engaging portion and the soldering portion of the terminal are disposed at different horizontal planes, thus making the overall height of the electrical connector high and make the electrical connector unsuitable for compact and thin application.

Hence, it is desirable to provide an electrical connector terminal and a method of mounting terminals onto the PCB to overcome the aforementioned disadvantages.

SUMMARY OF THE INVENTION

Accordingly, an object of the present invention is to provide an electrical connector terminal benefited with low profile suitable for compact and thin application.

According to one aspect of the present invention, an electrical connector assembly comprises a printed circuit board (PCB) having opposite upper and lower surfaces and a plurality of terminals disposed on the upper surface of the PCB. Each terminal comprises a base portion, a contacting portion extending from the base portion and a soldering portion extending from the base portion and soldered to the upper surface of the PCB. The contacting portion, the base portion and the soldering portion are disposed in a manner of side-by-side respectively along an extending direction of the upper surface of the PCB.

Other objects, advantages and novel features of the invention will become more apparent from the following detailed description when taken in conjunction with the accompanying drawings, in which:

DETAILED DESCRIPTION OF THE INVENTION

Reference will now be made to the drawings to describe the present invention in detail.

Figure 1:
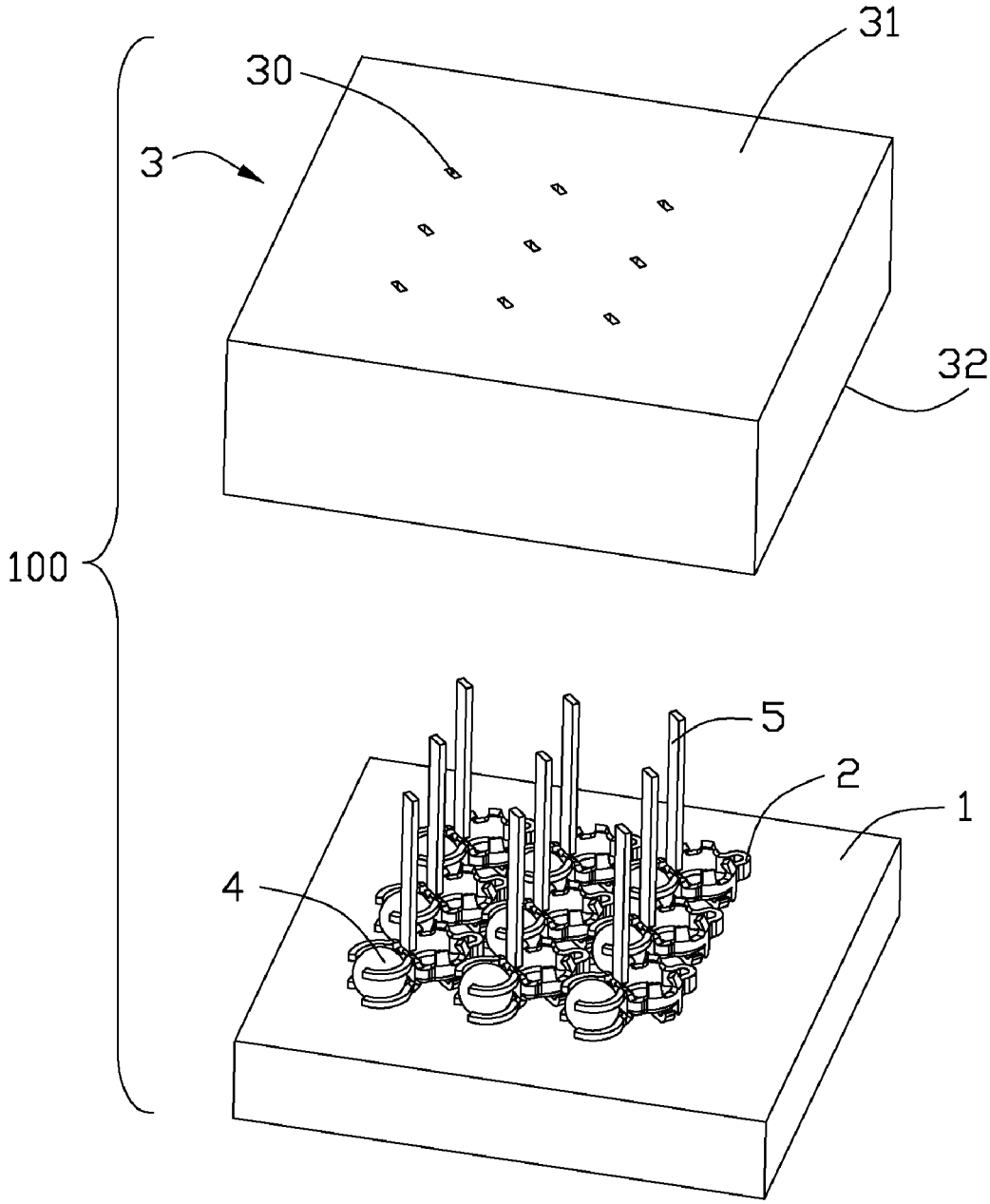
FIG. 1 is an assembled, isometric view of a preferred embodiment of an electrical connector assembly according to the present invention, showing an insulating housing separated from terminals and terminals soldered to the PCB.
Figure 2:
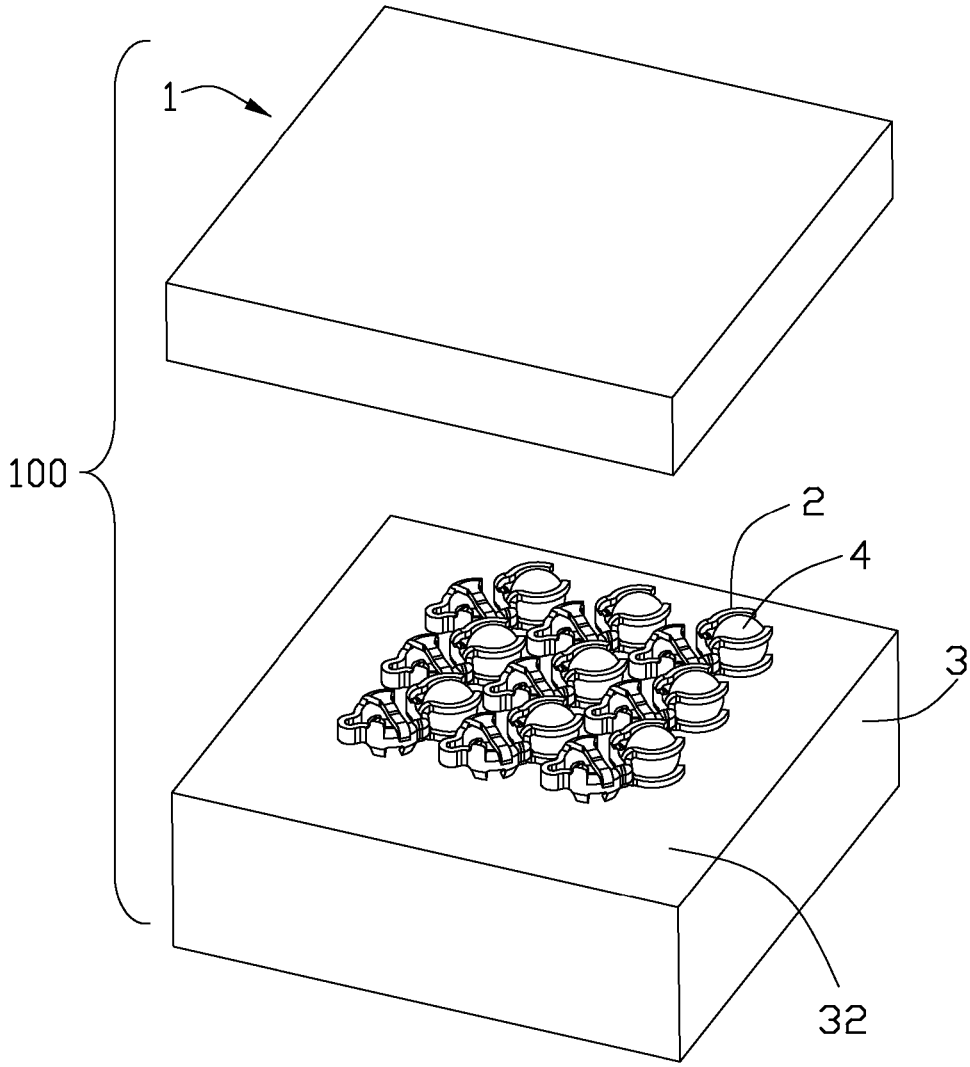
FIG. 2 is another assembled, isometric view of the electrical connector assembly, showing the terminals assembled on the insulating housing and not placed on the PCB.
Figure 3:
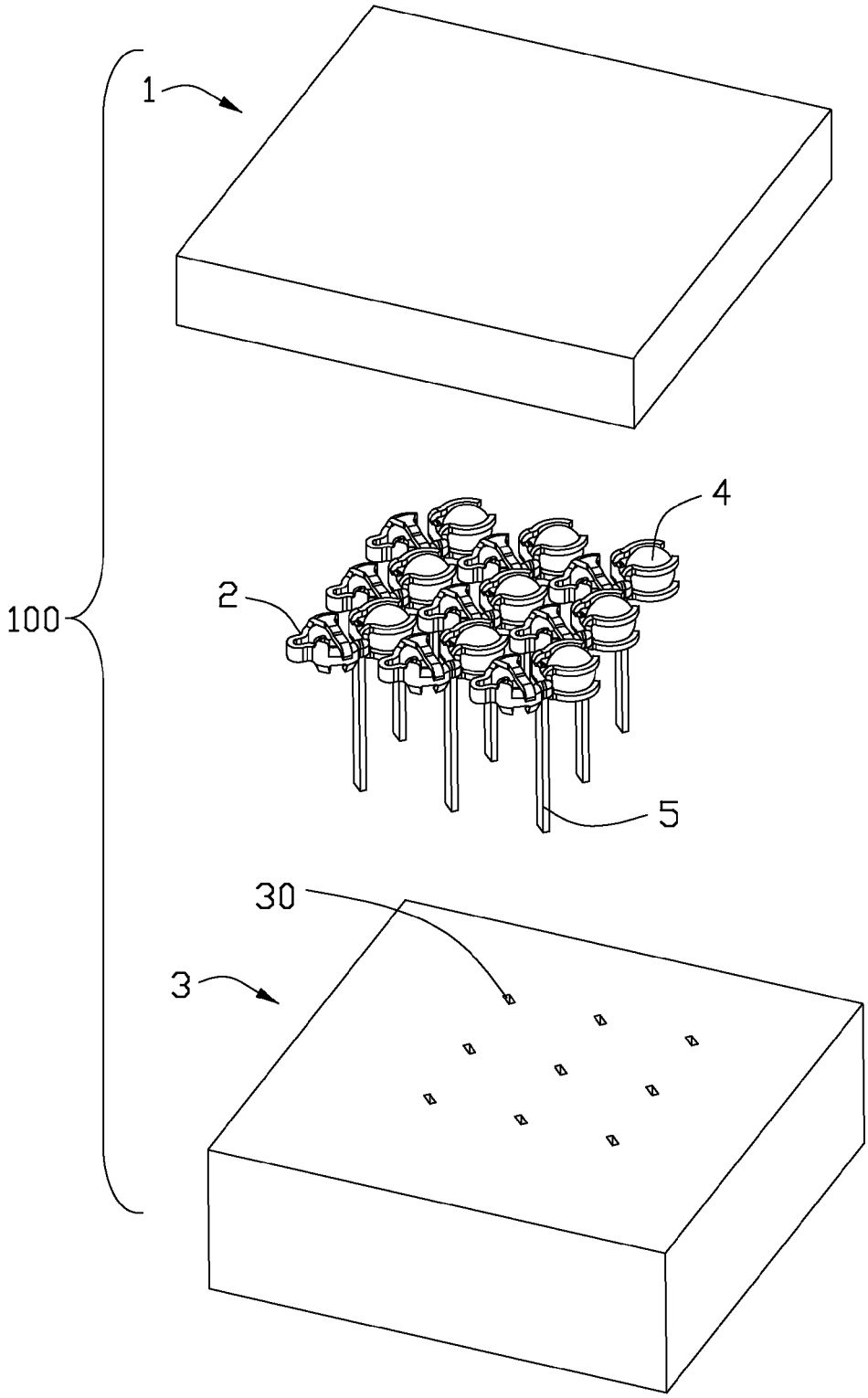
FIG. 3 is an exploded, perspective view of the electrical connector assembly shown in FIG. 2.
Figure 4:
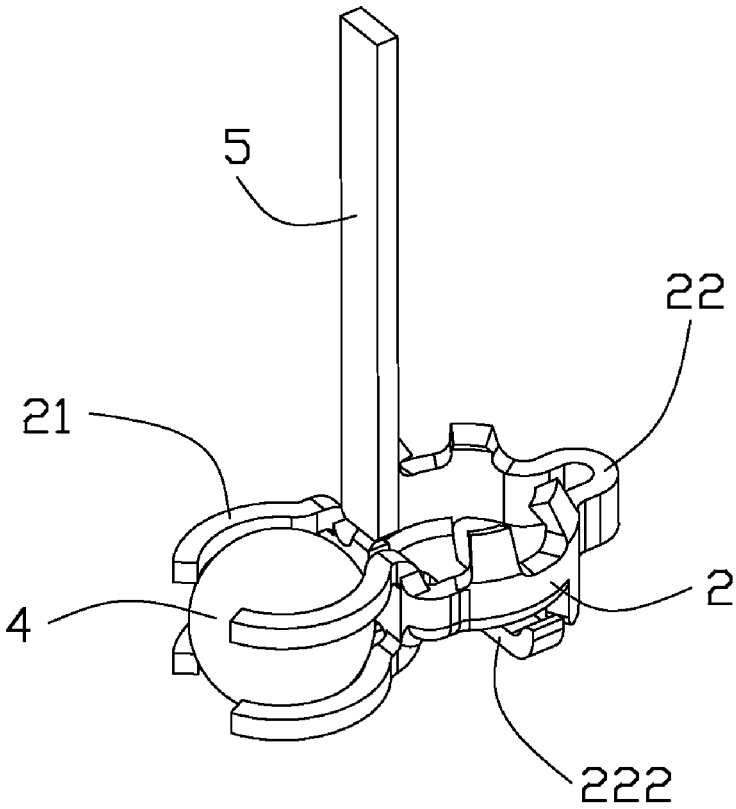
FIG. 4 is an isometric view of the terminal with a fusible member of FIG. 1, showing a strip junction not removed from the terminal.
Figure 5:
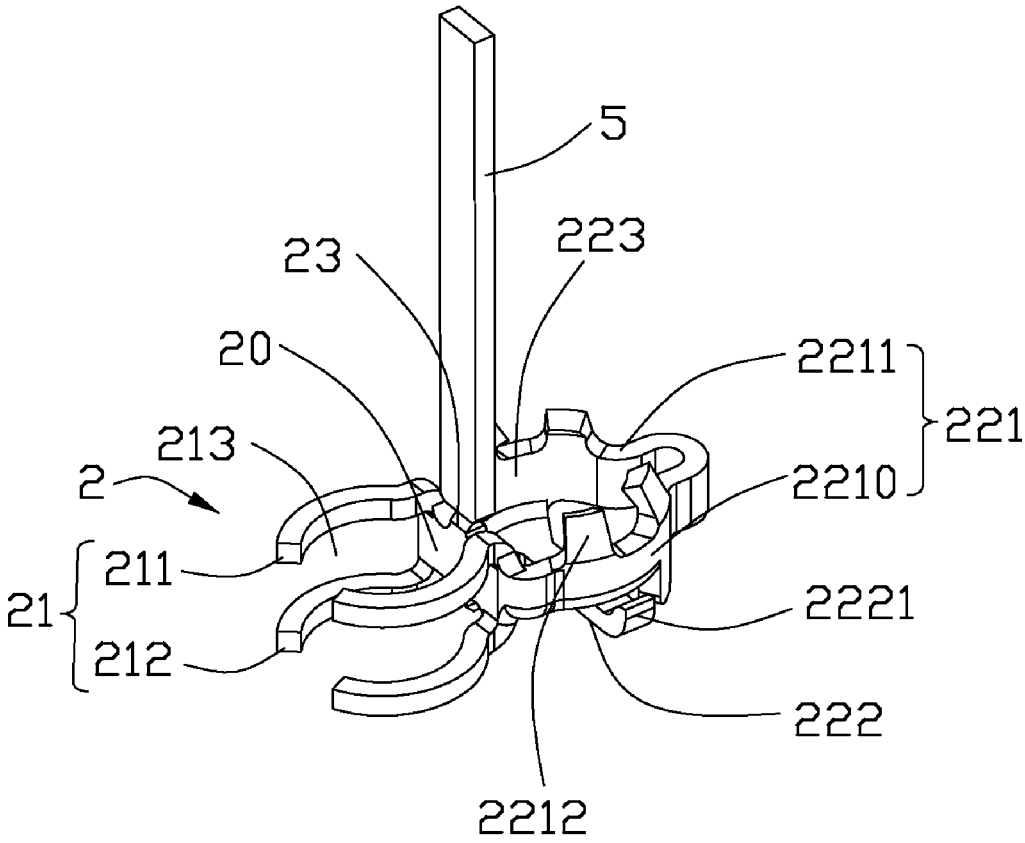
FIG. 5 is similar to FIG. 4, only without the fusible member.
Figure 6:
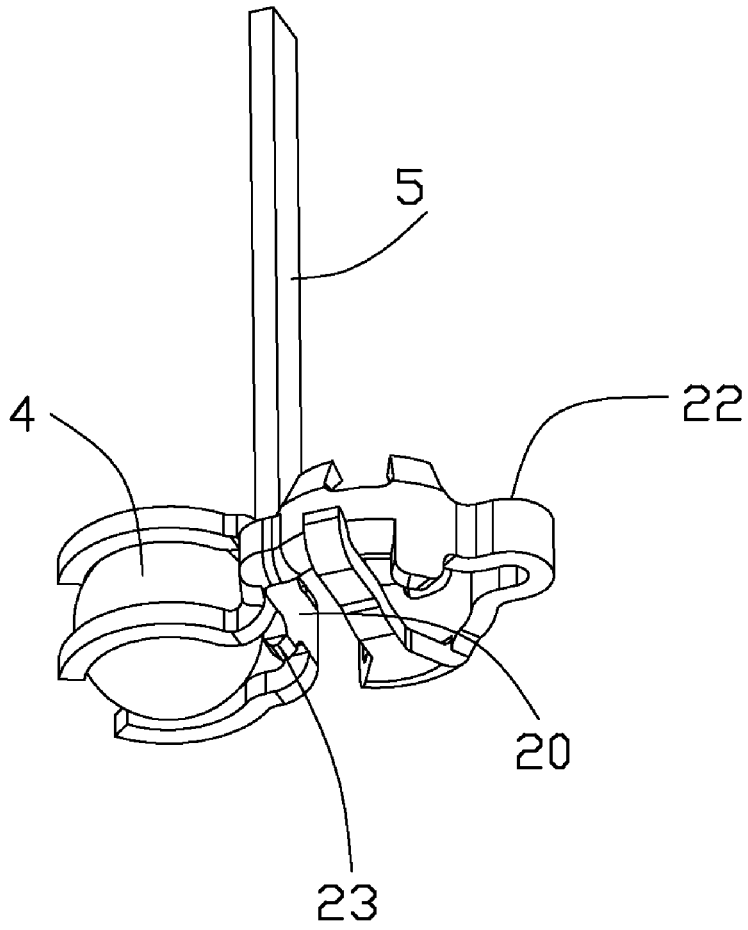
FIG. 6 is another isometric view of the terminal shown in FIG. 4.
Figure 7:
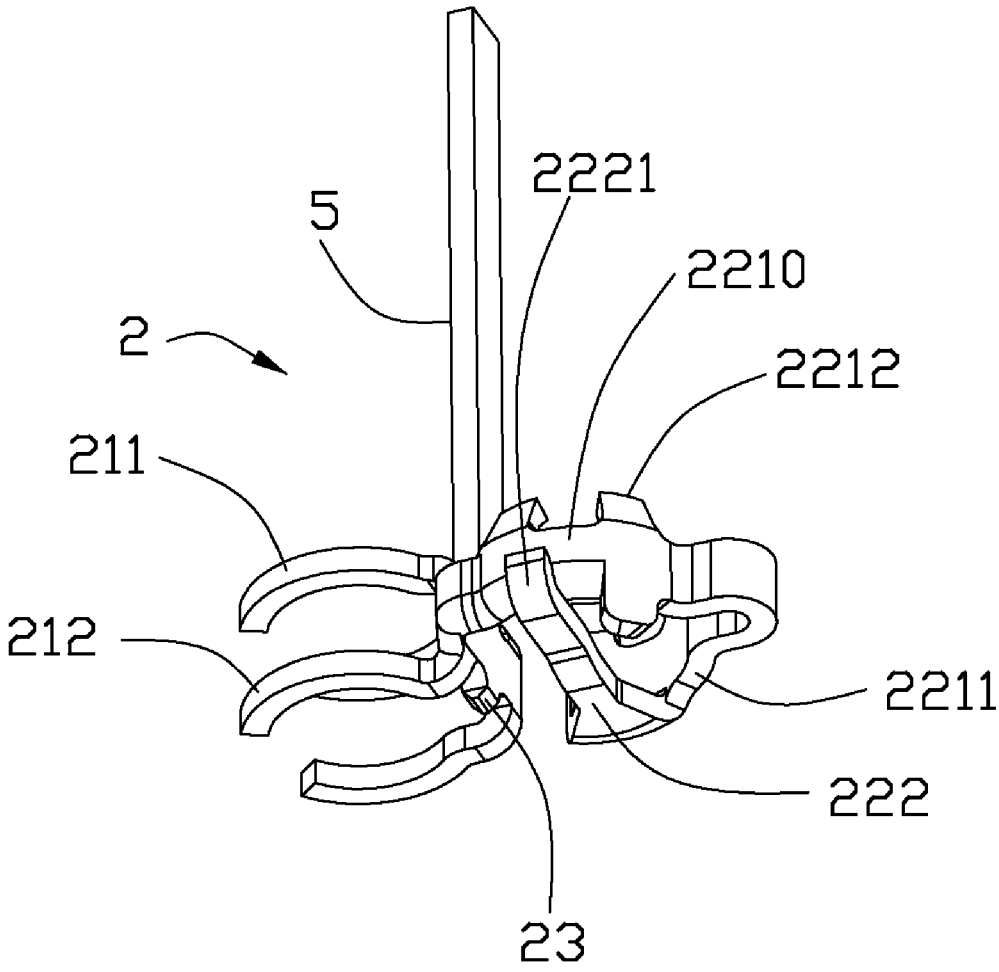
FIG. 7 is similar to FIG. 6, only without the fusible member.
Figure 8:
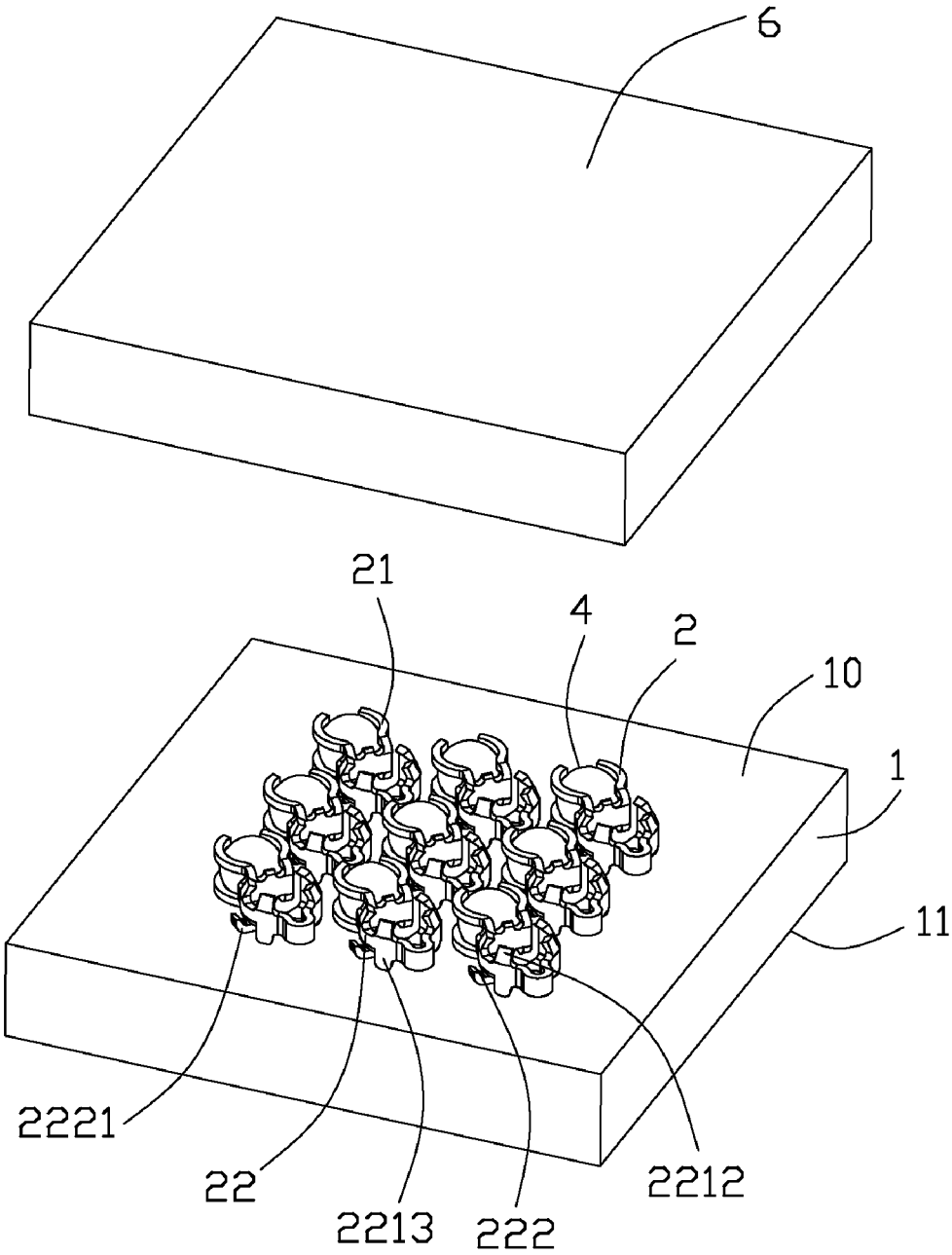
FIG. 8 is an assembled, isometric view of the electrical connector assembly, showing a central process unit (CPU) not assembled to the PCB.
Figure 9:
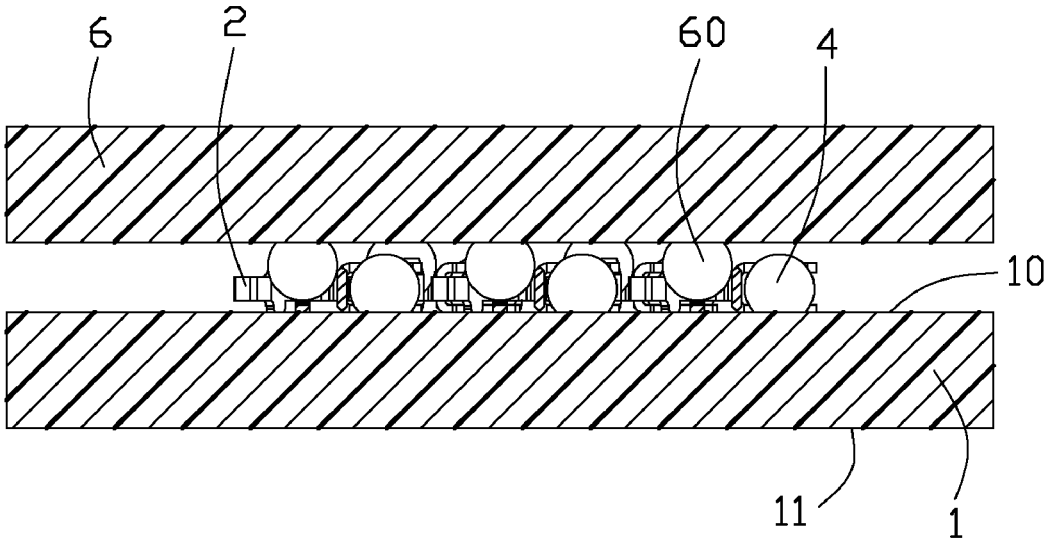
FIG. 9 is a cross-sectional view of the electrical connector assembly, showing the CPU assembled on the PCB.

FIGS. 1 to 9 illustrate an electrical connector assembly 100 in accordance to a preferred embodiment of the present invention comprises a printed circuit board 1 having opposite upper and lower surfaces 10, 11 and a carrier 3 having opposite top and bottom surfaces 31, 32 and a plurality of terminals 2 disposed on the bottom surface 32 thereof. Each terminal 2 has a fusible member 4 disposed thereon. The carrier 3 is an insulating housing and has a plurality of through holes 30 extending from the top surface 31 to the bottom surface 32. The carrier 3 can place the terminals 2 on the upper surface 10 of the PCB 1 and is able to be removed from the terminals 2 when the terminals 2 are soldered to the PCB 1 through the fusible members 4.

Referring to FIGS. 4 to 8, the terminals 2 are disposed on the PCB 1 along an extending direction of the upper surface 10. Each terminal 2 includes a vertical base portion 20, a contacting portion 22 extending horizontally from a side edge of the base portion 20 and a soldering portion 21 extending horizontally from the base portion 20. The base portion 20 has a strip junction 5 extending upwardly from a middle position of a top edge thereof and a supporting portion 23 extending downwardly form a bottom edge thereof. The strip junctions 5 contact with a contact strip (not shown) when the terminals 2 are manufactured and are received in the through holes 30 of the insulating housing 3 to dispose the terminals 2 on the bottom surface 32. The strip junctions 5 will be removed from the base portion 20 after the insulating housing 3 is removed from the terminals. The supporting portion 23 can abut against the upper surface 10 of the PCB 1 to position the terminal 2 on the PCB 1.

A first receiving space 223 is formed by the base portion 20 and the contacting portion 22 for receiving a conductor 60 of a central processing unit (CPU) 6. A second receiving space 213 is defined by the base portion 20 and the soldering portion 21 for receiving the corresponding fusible member 4. The first and second receiving spaces 223, 213 are located at two opposite sides of the base portion 20. The first receiving space 223, the base portion 20 and the second receiving space 213 are disposed one by one along an extending direction of the upper surface 10 of the PCB 1. Projections of the first and second receiving spaces 223, 213 in the upper surface 10 of the PCB 1 are staggered with each other.

The contacting portion 22 includes at least one contacting arm 221 extending horizontally from the base portion 20 in a curved manner to commonly form a circle in a top view. The first receiving space 223 is defined by the contacting arm 221 and the base portion 20. The contacting arm 221 comprises a first arm 2210 extending horizontally from the side edge of the base portion 20 and a second arm 2211 bent from a free end of the first arm 2210 and extending horizontally toward the base portion 20. A holding arm 222 extends from a horizontal bottom edge of the second arm 2211 toward the first arm 2210. The holding arm 222 defines a hook 2221 at a free end thereof, for clasping the first arm 2210 to retain the conductor 60 of the CPU 6 in the first receiving space 223. A plurality of claws 2212 are formed on a horizontal upper edge of the contacting arm 221 for coupling the conductor 60 of the CPU 6. At least one tab 2213 is formed on a lower edge of the contacting arm 221.

The soldering portion 21 includes two pair of clamping arms extending horizontally from the base portion 20. The second receiving space 213 is formed by the clamping arms and the base portion 20. The contacting arm 221 and the clamping arms extend from different radial position with regard to the base portion 20. The clamping arms can hold the fusible member 4 in the second receiving space 213 and include a pair of upper clamping arms 211 extending horizontally from two opposite ends of the top edge of the base portion 20 and a pair of lower clamping arms 212 extending horizontally from two opposite ends of the bottom edge of the base portion 20.

The electrical connector assembly 100 has a low overall height to meet low profile application because the terminal 2 has a horizontal structure of 8 shape and the insulating housing 3 will be removed from the terminals 2 after the terminals 2 are soldered to the PCB 1 through the fusible members 4.

While the preferred embodiments in accordance with the present invention has been shown and described, equivalent modifications and changes known to persons skilled in the art according to the spirit of the present invention are considered within the scope of the present invention as defined in the appended claims.

What is claimed is:

1. An electronic interconnecting system comprising:

a printed circuit board (PCB) having opposite upper and lower surfaces;

a plurality of terminals disposed on the upper surface of the PCB, each terminal including: a base portion; a contacting portion extending from the base portion; and a soldering portion extending from the base portion and soldered on the upper surface of the PCB;

wherein the contacting portion, the base portion and the soldering portion are disposed in a horizontal extension manner;

wherein the contacting portion, the base portion and the soldering portion are arranged in a side-by-side manner respectively along an extending direction of the upper surface the terminal has a fusible member disposed thereon, and wherein a first receiving space is defined by the contacting portion and the base portion for receiving a conductor of an electronic package and a second receiving space is formed by the soldering portion and the base portion for receiving the corresponding fusible member;

wherein the contacting portion includes at least one contacting arm extending horizontally from the base portion, and wherein the soldering portion includes a plurality of clamping arms extending horizontally from the base portion, and wherein the contacting arm and the clamping arms are located at two opposite sides of the base portion.

2. The electronic interconnecting system as claimed in claim 1, wherein projections of the first and second receiving spaces in the upper surface of the PCB are staggered with each other.

3. The electronic interconnecting system as claimed in claim 1, further including an electronic package mounted above the PCB under condition that the contacting portion and the soldering portion are essentially exposed between the PCB and the electronic package.

4. The electronic interconnecting system as claimed in claim 1, wherein in each terminal the contacting arm and the clamping arms extend from different radial positions with regard to the base portion, and wherein the first receiving space is defined by the contacting arm and the base portion, and wherein the second receiving space is defined by the clamping arms and the base portion.

5. The electronic interconnecting system as claimed in claim 1, wherein the contacting arm comprises a first arm extending horizontally from the side edge of the base portion and a second arm bent from the first arm and extending horizontally toward the base portion, and wherein the contacting portion further includes a holding arm extending from bottom edge of the second arm toward the first arm, and wherein the holding arm defines a hook matching with the first arm to retain the conductor of the electronic package in the first receiving space.

6. The electronic interconnecting system as claimed in claim 1, wherein a plurality of claws are formed on a horizontal upper edge of the contacting arm for coupling to the conductor of the electronic package, and wherein at least one tab is formed on a horizontal lower edge of the contacting arm, and wherein a supporting portion extend downwardly from the base portion for supporting the terminal on the PCB before soldered to the PCB.

7. An electrical connector terminal assembly for interconnecting two electronic components, comprising:

a contacting portion defining a first receiving space for receiving a conductor of one of said electronic components; and a soldering portion defining a second receiving space for receiving an electronic part for connecting to the other of the two electronic components;

wherein the first receiving space and the second receiving space are arranged in a horizontal extension manner;

wherein said terminal further includes a base portion and contacting portion and the soldering portion extend from the base portion respectively, and wherein the contacting portion includes at least one contacting arm extending horizontally from a side edge of the base portion in a curved manner to commonly form a circle in a top view, and wherein the soldering portion includes a plurality of clamping arms extending horizontally from the base portion.

8. The electrical connector terminal assembly as claimed in claim 7, wherein the contacting arm and the clamping arms extend from different radial positions with regard to the base portion and wherein a supporting portion extends downwardly from the base portion.

9. The electrical connector terminal assembly as claimed in claim 7, wherein the contacting portion is configured with resiliency so as to abut against a relatively stiff electronic part of the corresponding electronic component under condition that both the contacting portion and the soldering portion are arranged to be located between the two electronic components in a vertical direction and transversely exposed without intimately enclosure by any insulative housing.

10. The electrical connector terminal assembly as claimed in claim 7, wherein a holding arm extends horizontally from a bottom edge of one side of the contacting arm toward the other side of the contacting arm, and wherein the holding arm defines a hook matching with the other side of the contacting arm to retain the conductor of the corresponding electronic component in the first receiving space.

11. The electrical connector terminal assembly as claimed in claim 10, wherein a plurality of claws are formed on a horizontal upper edge of the contacting arm for coupling to the conductor of the corresponding electronic component, and wherein at least one tab extends downwardly from a lower edge of the contacting arm.

* * * * *